US007378210B2

(12) United States Patent
Hiraoka et al.

(10) Patent No.: US 7,378,210 B2
(45) Date of Patent: May 27, 2008

(54) ELECTROPHOTOGRAPHIC TONER AND MANUFACTURING METHOD THEREOF, POLYESTER RESIN FOR ELECTROPHOTOGRAPHIC TONER AND MANUFACTURING METHOD THEREOF, ELECTROPHOTOGRAPHIC DEVELOPER AND IMAGE FORMING METHOD

(75) Inventors: Satoshi Hiraoka, Minamiashigara (JP); Yasuo Yamamoto, Minamiashigara (JP); Hideo Maehata, Minamiashigara (JP); Yasuo Matsumura, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 342 days.

(21) Appl. No.: 11/074,629

(22) Filed: Mar. 9, 2005

(65) Prior Publication Data

US 2005/0255398 A1 Nov. 17, 2005

(30) Foreign Application Priority Data

May 14, 2004 (JP) ..... 2004-145513
Aug. 3, 2004 (JP) ..... 2004-226417

(51) Int. Cl.
*G03G 9/087* (2006.01)

(52) U.S. Cl. ..... 430/109.4; 430/124; 430/137.14

(58) Field of Classification Search ..... 430/109.4, 430/109.1, 124, 137.14
See application file for complete search history.

(56) References Cited

U.S. PATENT DOCUMENTS 5,744,560 A * 4/1998 Foucher et al. ..... 526/221
5,990,264 A * 11/1999 Drysdale ..... 528/271
2005/0014980 A1* 1/2005 van Hal et al. ..... 568/867
2005/0255397 A1 11/2005 Yamamoto et al.

FOREIGN PATENT DOCUMENTS

| | | |
|---|---|---|
| JP | A 42-023910 | 11/1967 |
| JP | A 51-061595 | 5/1976 |
| JP | A 62-087248 | 4/1987 |
| JP | A 62-291668 | 12/1987 |
| JP | A 03-188047 | 8/1991 |
| JP | A 04-288041 | 10/1992 |
| JP | A-07-149878 | 6/1995 |
| JP | A-08-044111 | 2/1996 |
| JP | A-08-286416 | 11/1996 |
| JP | A-09-269610 | 10/1997 |
| JP | A 10-026842 | 1/1998 |
| JP | B2-2826634 | 9/1998 |
| JP | A 11-024306 | 1/1999 |
| JP | A 2001-265057 | 9/2001 |
| JP | B2-3348471 | 9/2002 |
| JP | A 2002-311639 | 10/2002 |
| JP | A 2002-311769 | 10/2002 |
| JP | A 2002-341587 | 11/2002 |
| JP | A 2003-107802 | 4/2003 |
| JP | A 2003-335727 | 11/2003 |

* cited by examiner

*Primary Examiner*—John L Goodrow
(74) *Attorney, Agent, or Firm*—Oliff & Berridge, PLC

(57) ABSTRACT

The present invention provides a binder resin that is used for an electrophotographic toner, an electrophotographic toner using the same, and a manufacturing method thereof, as well as an electrophotographic developer and an image forming method. The binder resin includes a rare earth element in a range of about 1 to 10000 ppm and is preferably made of a polyester resin. The polyester resin is preferably synthesized from from an acid unit having a dicarboxylic acid group and an alcohol unit having a diol group by use of a non-homogeneous catalyst in which a rare earth metal triflate or a rare earth metal triflylimide is carried on a carrier.

17 Claims, No Drawings

ELECTROPHOTOGRAPHIC TONER AND MANUFACTURING METHOD THEREOF, POLYESTER RESIN FOR ELECTROPHOTOGRAPHIC TONER AND MANUFACTURING METHOD THEREOF, ELECTROPHOTOGRAPHIC DEVELOPER AND IMAGE FORMING METHOD

CROSS-REFERENCE TO RELATED APPLICATIONS

This application claims priority under 35USC 119 from Japanese Patent Applications Nos. 2004-145513 and 2004-226417, the disclosures of which are incorporated by reference herein.

BACKGROUND OF THE INVENTION

1. Field of the Invention

The present invention relates to a binder resin that is used for an electrophotographic toner that can be used in an electrophotographic device such as a copy machine, a printer or a facsimile machine that makes use of an electrophotographic process, an electrophotographic toner using the same and a manufacturing method thereof, an electrophotographic developer, and an image forming method.

2. Description of the Related Art

Many electrophotographic methods are known (for example, see Japanese Patent Application Publication (JP-B) No. 42-23910). In general, through a plurality of processes by various means, an electrical latent image is formed on a surface of a photoreceptor (latent image holding body) that makes use of a photoconductive material, then after the formed latent image is developed by use of a toner to form a toner image, the toner image on the surface of the photoreceptor, is transferred onto a surface of a transfer receiving material such as paper with or without the use of an intermediate transfer body, and the transferred image is fixed by heating, pressing, heating and pressing or a solvent vapor, whereby a fixed image is formed. If necessary, the toner that remains on a surface of the photoreceptor is clean by various methods and supplied again to the above plurality of processes.

As a fixing technique for fixing an image transferred onto a surface of the transfer receiving material, a heating roller fixing method in which and a pressure roller, a transfer receiving material onto which a toner image is transferred is inserted between a pair of rollers including a heating roller for fixing is generally used. Furthermore, as a similar technique, one constituted by replacing one or both of rollers with a belt or belts is also known. These techniques, in comparison with other fixing methods, can generate strong fixed images at high speed, are higher in energy efficiency, and cause less damage to the environment by volatilization of solvents and so on.

On the other hand, in order to reduce the amount of energy used by a copy machine or a printer, a technique that can fix a toner with lower energy is desired. Accordingly, an electrophotographic toner that can be fixed at lower temperatures is strongly demanded.

As a means for lowering a fixing temperature of a toner, a means for lowering a glass transition temperature of a toner resin (binder resin) is used. As a toner binder resin, polyester can be used, and, in particular for electrophotography, a crystalline polyester resin is used. The polyester contains acid groups and hydroxyl groups and is liable to be affected by its environment, and in particular, humidity. As attempts to improve chargeability, a proposal to make an acid value of resin lower (Japanese Patent Application Laid-Open (JP-A) No. 62-291668), and proposals to use an organic fluorinated compound (JP-A No. 11-24306 or 2003-107802) are disclosed; however, these are insufficient in the chargeability.

Furthermore, as a toner that uses a rare earth element compound, one in which an α-Si photoreceptor, a monocomponent magnetic toner, and a combination of a rare earth fluoride element compound and a rare earth oxide element compound is disclosed (for example, JP-A Nos. 20022000-311769 and 2002-311639). Still furthermore, a toner that uses a binder resin and a toner that uses cerium oxide and a rare earth element compound as external additives are disclosed (for example, JP-A No. 2002-341587 and 2001-265057).

All examples use a method in which a rare earth compound is externally added on a surface of a toner and are intended to improve cleaning defects.

On the other hand, recently, in view of reduction in environmental burden (reduction of $CO_2$ gas), energy-saving manufacturing methods have been proposed. In the field of electrophotography (for example, JP-A No. 10-26842), from the viewpoint of energy saving, there is strong demand in the market for reduction in the amount of energy used to manufacture toner and the amount of energy that a printer or a copy machine uses.

As to a manufacturing method of toners, from conventional processes such as melt kneading, pulverizing and classifying, a suspension polymerizing method and a melt-suspension method have been developed, and from the viewpoint of the manufacturing energy, reduction thereof is progressing.

However, the energy necessary for the manufacture of toner resin has not yet been sufficiently reduced.

In particular, in the case of polyester resins that can lower fixing energy, in comparison with vinyl polymerization resins, much energy is still consumed in the manufacture thereof. Accordingly, the total energy consumed in the manufacture of the resin and the toner is great.

For example, in the manufacture of toner resins, so far, tin-based catalysts including dibutyl tin oxide and titanium-based catalysts including titanium oxide have generally been used. As catalysts for polymerizing polyester, dialkyl tin oxide, dialkyl tin carboxylate, hydroxymonoalkyl tin oxide, and dialkyldistannoxane have been used as a catalysts for polyester resin. For example, in JP-A Nos. 51-61595 and 62-87248, a polymerization method that uses dialkyldistannoxane is proposed, and in JP-A Nos. 03-188047 and 04-288041, a polymerization method that uses organic tin is proposed. However, when, a high molecular weight polymer compound necessary for imparting viscoelasticity and durability to toner is manufactured using these methods, there are problems in that reaction conditions of a high temperature (150° C. or more) and a low vacuum are necessary, and in that it is difficult to recover and reuse the catalyst after the reaction. Accordingly, it is difficult to regard these methods as industrially sufficient methods.

As a method for overcoming the problem of recovering a catalyst, for example in JP-A No. 2003-335727, a method in which two kinds of solvent are used to conduct polymerization and a catalyst is extracted in one solvent layer is proposed. However, a special fluorinated solvent is necessary in the method. Furthermore, since a Lewis acid is used as the catalyst that is used in the polycondensation, the catalyst is decomposed by water and difficult to recover and reuse.

On the other hand, the present inventors synthesized a polyester resin by use of a rare earth triflate catalyst and tried to prepare a toner using the polyester resin. However, the toner was found to have a defect in that a long-term storability of an image was poor. Furthermore, it was also found that since a low molecular weight component was present in the polyester resin, the fixing strength became poor.

SUMMARY OF THE INVENTION

The present invention provides a binder resin that is used in an electrophotographic toner and can realize an electrophotographic toner that is excellent in the long-term storability of an image, has improved fixing strength and is excellent in image formation and/or charging stability. In particular, the invention provides a manufacturing method of a polyester resin for electrophotographic toner from which a nonhomogeneous catalyst can be readily recovered, and a polyester resin obtained thereby. Furthermore, the invention provides an electrophotographic toner containing the binder resin and a manufacturing method thereof. Still furthermore, the invention provides an electrophotographic developer containing the electrophotographic toner and an image forming method that uses the electrophotographic toner.

That is, the invention provides an electrophotographic toner comprising a binder resin and a coloring agent, wherein the binder resin contains a rare earth element in a range of about 1 to 10000 ppm.

The invention further provides a method for manufacturing the electrophotographic toner including: blending a particle dispersion solution of a binder resin and a particle dispersion solution of a coloring agent to aggregate particles of the binder resin and particles of the coloring agent; and heating the aggregated particles to a temperature equal to or greater than a glass transition temperature or a melting point of the binder resin to fuse aggregated particles.

The invention further provides an image forming method including: forming an electrostatic latent image on a surface of a latent image holder; developing, by use of a developer carried on a developer carrier, the electrostatic latent image formed on the surface of a latent image holder to form a toner image; transferring the toner image formed on the surface of the latent image holder onto a surface of a transfer receiving material; and thermally fixing the transferred toner image on the surface of the material, wherein the developer comprises a carrier and the electrophotographic toner.

An electrophotographic toner according to one mode of the invention contains a polyester resin, that is preferably synthesized by use of a particular non-homogeneous catalyst as a binder resin. Accordingly, an image formed therewith is excellent in fixing strength and storability.

Furthermore, in the manufacturing method of the polyester resin for electrophotographic toner according to another mode of the invention, after synthesis, a used non-homogeneous catalyst can be easily recovered and reused.

DETAILED DESCRIPTION OF THE INVENTION

Hereinafter, a binder resin, an electrophotographic toner and a manufacturing method thereof, an electrophotographic developer and an image forming method according to the present invention will be described in detail.

Binder Resin

A binder resin according to the invention contains a rare earth element in a range of about 1 to 10000 ppm. The binder resin according to the invention is preferably used as a binder resin contained in an electrophotographic toner. In the invention, ppm means parts per million by mass.

In the binder resin according to the invention, when a content of the rare earth element is less than about 1 ppm, in the case of the binder resin of the invention being used in an electrophotographic toner, the toner is not charged. Accordingly, in some cases, a sharp image cannot be obtained.

On the other hand, when a content of the rare earth element is more than about 10000 ppm, since the toner charges too much, fogging or staining of a background is caused in some cases.

The content of the rare earth element in the binder resin according to the invention is preferably in a range of about 5 to 5000 ppm.

A kind of the rare earth element contained in the binder resin according to the invention is not restricted to a particular kind but is preferably Sc, Y, Yb or Sm, and more preferably is Sc.

The kind of the rare earth element contained in the binder resin according to the invention may be one kind or two or more kinds. When two or more kinds of rare earth elements are contained in the binder resin according to the invention, a sum total of the two or more kinds of rare earth elements are taken as a content of the rare earth element.

As a method of incorporating the rare earth element in the binder resin according to the invention, a method where, when the binder resin according to the invention is synthesized or an electrophotographic toner is manufactured according to a method described below, a rare earth compound is added can be used. As the rare earth compound, inorganic salts such as an oxide, a hydroxide, an oxoacid salt, an acetate, an oxalate, a thiocyanate, a cyanate, a boride, a silicide, a sulfate, a chloride and a fluoride can be used.

In the case where a rare earth compound is added when the binder resin according to the invention is synthesized, a method in which a catalyst containing a rare earth element is used as the rare earth compound and the catalyst remains in the binder resin is preferably used.

Furthermore, the rare earth element can be incorporated in the binder resin heating and melting the binder resin, and adding a compound containing the rare earth element thereto, followed by agitating.

The binder resin according to the invention is not particularly limited as far as it contains a rare earth element in a range of about 1 to 10000 ppm, but is preferably a polyester resin, and is more preferably a crystalline polyester resin. When the crystalline polyester resin is used, fixability with respect to to paper is improved, and furthermore toner blocking resistance, storability of an image and low-temperature fixability are improved.

The binder resin according to the invention is preferably synthesized by use of a catalyst represented by the following Formula (1).

$$X(OSO_2CF_3)_3 \qquad \text{Formula (1)}$$

In the Formula (1), X represents a rare earth element, and among rare earth elements, Sc, Y, Yb or Sm is preferable.

Furthermore, the binder resin according to the invention is preferably synthesized by use of a catalyst represented by the following Formula (2).

$$X(N(SO_2CF_3)_2)_3 \qquad \text{Formula (2)}$$

In the Formula (2), X represents Sc, Y, Yb or Sm.

When the synthesis is carried out by use of a catalyst represented by the formula (1) or (2), a rare earth element can be incorporated in the binder resin.

The catalysts represented by the Formulas (1) or (2) can be preferably used in the synthesis of the polyester resin.

Synthesis of a polyester resin wherein the catalyst represented by the Formula (1) or (2) is used will be described below.

An amount of the catalyst that is used is preferably in a range of about 0.01 to 10% by mass with respect to a resin that is generated. When it is less than the above amount, an esterification reaction of polycondensation becomes slower, and when it exceeds the above amount the charge amount and so on are adversely affected.

The catalyst allows polycondensation at lower temperatures than tin-based catalysts and titanium-based catalysts that have been conventionally used. Specifically, in order to obtain a polyester resin having a weight-average molecular weight Mw of 20000 in the same time period, while the existing catalyst necessitates a reaction temperature of about 180° C. or more, the resin according to the invention can be obtained at a temperature equal to about 150° C. or lower.

When the catalyst represented by the Formula (1) or (2) is used, the energy necessary for manufacturing the polyester resin can be lowered.

The manufacturing method of the polyester resin is not particularly restricted. Generally-known methods for polyester polymerization, in which acid units (units having acid groups) and alcohol units (units having alcohol groups) are reacted, can be used. For example, a direct polycondensation method, an ester interchange method and so on can be used depending on the kinds of monomers. Further, the reaction form of the polymerization is not particularly limited and may be a solution polymerization, a block polymerization or the like. However, the block polymerization is preferable. Still furthermore, in the case of the block polymerization, in order to promote dehydration, it is important to lower a reaction pressure to an appropriate level. In the invention, when the pressure is lowered to about 40 mmHg or less, the reaction can be preferably advanced.

A molar ratio (acid unit/alcohol unit) when the acid unit and the alcohol unit are reacted, which differs different depending on the reaction conditions and so on, cannot be clearly stated; however, it is normally about 1/1. In the catalyst, although an esterification reaction proceeds more the higher the reaction temperature is, an optimum temperature for polymerization in the invention is about 120° C. or lower.

The polyester resin is preferably synthesized from an acid unit having a dicarboxylic acid group and an alcohol unit having a diol group. In the polyester resin, a constituent site that is an acid unit before the synthesis of the polyester resin is referred to in the explanation below as an "acid-derived constituent", and a constituent site that is an alcohol unit before the synthesis of the polyester resin is referred to in the explanation below as an "alcohol-derived constituent".

As the binder resin according to the invention, a crystalline polyester resin is preferable. When the polyester resin is not crystalline, that is, when it is amorphous, in some cases, it is difficult to maintain the toner blocking resistance and the image storability while securing excellent low-temperature fixability.

In the invention, the "crystallinity" of the "crystalline polyester resin" means to have, not a step-wise change in absorbed heat quantity, but rather a distinct absorption peak in differential scanning calorimetry (DSC). Furthermore, in some cases, the absorption peak may be a peak with a width of about 40 to 50° C. when crystalline polyester resin is rendered into a toner. In the case of a polymer in which other components are copolymerized to a main chain of the crystalline polyester, is the other components are contained in an amount of 50% by mass or less, this copolymer is also referred as a crystalline polyester.

In particular, the electrophotographic toner according to the invention contains at least a binder resin and a coloring agent, the binder resin preferably being a polyester resin that is synthesized by use of a non-homogeneous catalyst in which a rare earth metal triflate or a rare earth metal triflylimide is carried on a carrier.

A polyester resin for electrophotographic toner that is used in an electrophotographic toner according to the invention is preferably crystalline. The non-homogeneous catalyst in which the rare earth metal triflate or rare earth metal triflylimide is carried on a carrier and which is used for synthesizing the polyester resin for use in the electrophotographic toner according to the invention is preferably one represented by the structural formula (1) or (2).

As a method of causing the carrier to carry a rare earth metal triflate catalyst or a rare earth metal triflylimide catalyst, a method in which rare earth metal triflate or rare earth metal triflylimide is used after fixing in a carrier such as a polystyrene resin may be used (J. Am. Chem. Soc. 1998, vol. 120, pp. 2985-2986). Furthermore, it may be chemically bonded in a carrier such as a phosphine resin and used. Still furthermore, it may be encapsulated in a microcapsule as a carrier.

As the carrier of the non-homogeneous catalyst in the invention, inorganic material carriers such as carbon powder, alumina, silica, carbonates and halides of calcium, and carbonates and halides of magnesium and zeolite, and organic material carriers of polymers such as polystyrene, polyvinyl pyrrolidone, polyaniline, polyphosphine and polyethylene glycol can be used.

The catalyst that is used to synthesize the polyester resin according to the invention is insoluble in a solvent. Accordingly, a generated polyester resin and a catalyst can be readily separated and recovered, and the recovered catalyst can be reused.

Specifically, an optional solvent that can dissolve the polyester resin may be added to a reaction product to dissolve only the polyester resin, followed by filtering or centrifuging, whereby the catalyst remaining undissolved in the solvent and a polyester resin solution can be easily separated. An accretion to a surface of the catalyst can be readily removed by cleaning the catalyst with an appropriate solvent. Any solvent may be used as far as it can dissolve the polyester resin, and examples thereof include chloroform, xylene, benzene and toluene.

On the other hand, when the polyester resin is dropped in a poor solvent and precipitated again, it can be refined and recovered.

The polyester resin for electrophotographic toner according to the invention is preferably a crystalline polyester resin. When the polyester resin is crystalline, the toner blocking resistance and image storability can be retained while securing excellent low-temperature fixability. In the invention, the "crystallinity" of the "crystalline polyester resin" means to have, in differential scanning calorimetry (DSC), not a step-wise change in absorbed heat quantity, but rather a distinct absorption peak. Furthermore, in some cases, the absorption peak may be a peak having a width of about 40 to 50° C. when rendered in a toner. In the case of a polymer in which other components are copolymerized to a main chain of the crystalline polyester, if the other components are contained in an amount of 50% by mass or less, the copolymer is also referred as a crystalline polyester.

Next, an "acid-derived constituent" and an "alcohol-derived constituent" in the polyester resin according to the invention will be explained. The "acid-derived constituent" means a constituent site that is an acid unit before the synthesis of a polyester resin, and the "alcohol-derived constituent" means a constituent site that is an alcohol unit before the synthesis of the polyester resin.

Acid-Derived Constituent

As acids constituting the acid-derived constituent, various kinds of dicarboxylic acids can be used. However, as the acid-derived constituent in the polyester resin according to the invention, aromatic dicarboxylic acids and aliphatic dicarboxylic acids are preferable, among which, aliphatic carboxylic acids are preferable and straight chain type dicarboxylic acids are particularly preferable.

The aliphatic dicarboxylic acids include those such as oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12- dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters and acid anhydrides thereof but are not restricted thereto. Among these, from a viewpoint of easy availability, sebacic acid and 1,10-decanedicarboxylic acid are preferable.

As the aromatic dicarboxylic acid, for example, terephthalic acid, isophthalic acid, 2,6-naphthalene dicarboxylic acid, and 4,4'-biphenyl dicarboxylic acid can be used, among which, terephthalic acid is preferable from viewpoints of easy availability and the easiness in forming a low melting point polymer.

As the acid-derived constituents, it is preferable that, other than the aliphatic dicarboxylic acid-derived constituents and the aromatic dicarboxylic acid-derived constituents, constituents such as dicarboxylic acid-derived constituents having a double bond and dicarboxylic acid-derived constituents having a sulfonic acid group are included.

The dicarboxylic acid-derived constituent having a double bond includes, other than a constituent derived from dicarboxylic acid having a double bond, a constituent derived from lower alkyl ester or acid anhydride of dicarboxylic acid having a double bond. The dicarboxylic acid-derived constituent having a sulfonic acid group includes, other than a constituent derived from dicarboxylic acid having a sulfonic acid group, a constituent derived from lower alkyl ester or acid anhydride of dicarboxylic acid having a sulfonic acid group.

The dicarboxylic acid having a double bond, being able to crosslink the whole of the resin by making use of the double bond thereof, can be preferably used for inhibiting hot offset at the time of fixing. As such a dicarboxylic acid, for example, fumaric acid, maleic acid, 3-hexenedioic acid, 3-octendioic acid or the like can be used but it is not restricted thereto. Furthermore, lower alkyl esters and acid anhydrides thereof can be used. Among these, from a viewpoint of cost, fumaric acid and maleic acid are preferable.

The dicarboxylic acid having a sulfonic acid group is effective in that it can improve dispersion of a coloring agent such as a pigment or the like. Furthermore, when the whole of the resin is emulsified or suspended in water to prepare particles, if there is a sulfonic acid group, emulsifying or suspending can be realized without using a surfactant as described below. As such a dicarboxylic acid having a sulfonic acid group, for example, sodium 2-sulfoterephthalate salt, 5-sodium sulfoisophthalate salt, sodium sulfosuccinate salt or the like can be used, but it is not restricted to these compounds. Furthermore, lower alkyl esters and acid anhydrides of these compounds can be used. Among these, from a viewpoint of the cost, sodium 5-sulfoisophthalate salt or the like is preferable.

A content of the acid-derived constituents (the dicarboxylic acid-derived constituent having a double bond and the dicarboxylic acid-derived constituent having a sulfonic acid group) other than the aliphatic dicarboxylic acid-derived constituent and aromatic dicarboxylic acid-derived constituent in the total acid-derived constituents is preferably about 1 to 20% by constitutional mole, and more preferably about 2 to 10% by constitutional mole.

When the content is less than about 1% by constitutional mole the pigment dispersibility becomes inferior, the emulsion particle diameter becomes larger and a toner diameter is difficult to control owing to aggregation in some cases. On the other hand, when it exceeds about 20% by constitutional mole, the crystallinity of the polyester resin is deteriorated; the melting point is lowered; the image storability is worsened; and an emulsion particle diameter becomes small enough to dissolve in water, resulting in incapability of forming latex in some cases. In the present specification, "% by constitutional mole" means a percentage when the respective constituents (the acid-derived constituent and the alcohol-derived constituent) in the polyester resin are each defined as one unit (by mole).

Alcohol-Derived Constituent

As alcohols constituting the alcohol-derived constituent, aliphatic diols are preferable, and straight chain type aliphatic diols having 7 to 20 carbon atoms are more preferable. When the aliphatic diols are of a branched type, the crystallinity of the polyester resin is deteriorated and the melting point is lowered, whereby the toner blocking resistance, the image storability, and the low temperature fixing property are deteriorated in some cases.

Furthermore, when the number of the carbon atoms included in the chain is less than 7, in the case of the alcohol being polycondensated with the aromatic dicarboxylic acid, the melting point becomes higher and the low temperature fixation becomes difficult in some cases. On the other hand, when it exceeds 20, the materials are practically difficult to obtain. The number of the carbon atoms included in the chain is preferably 14 or less.

Furthermore, when the polyester resin is obtained by polycondensating with aromatic dicarboxylic acid, the number of the carbon atoms included in the chain is preferably an odd number. When the number of the carbon atoms included in the chain is an odd number, the melting point of a polyester resin becomes lower than that of the polyester resin having an even number thereof, and the melting point can be readily brought into a range described below.

Specific examples of the aliphatic diol include an ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. However, the aliphatic diol is not limited thereto. Among these, in consideration of easiness in availability, 1,8-octanediol, 1,9-nonanediol, and 1,10-decanediol are preferable, and from a viewpoint of lower melting point, 1,9-nonanediol is preferable.

In the alcohol-derived constituent, a content of the aliphatic diol-derived constituent is about 80% by constitutional mole or more, and other components may be contained as necessary. In the alcohol-derived constituent, the content of the aliphatic diol-derived constituent is preferably be about 90% by constitutional mole or more.

When a content of the aliphatic diol-derived constituents is less than about 80% by constitutional mole, the crystallinity of the polyester resin is deteriorated, and the melting point is lowered, whereby the toner blocking resistance, the image storability, and the low-temperature fixability are deteriorated in some cases. Examples of other components that are added as necessary include diol-derived constituents having a double bond and diol-derived constituents containing a sulfonic acid group.

Examples of the diol having a double bond include a 2butene-1,4-diol, 3-butene-1,6-diol, 4-butene-1,8-diol and the like. Examples of the diol having a sulfonic acid group include a sodium 1,4-dihydroxy-2benzenesulfonate salt, sodium 1,3-dihydroxymethyl-5-benzenesulfonate salt, and sodium 2-sulfo-1,4-butanediol salt and the like.

In the case where an alcohol-derived constituent (a diol-derived constituent having a double bond and a diol-derived constituent having a sulfonic acid group) other than the aliphatic diol-derived constituents is added, a content thereof is preferably about 1 to 20% by constitutional mole, and more preferably 2 to 10% by constitutional mole, in the total alcohol-derived constituents.

When the content of the alcohol-derived constituent other than the aliphatic diol-derived constituents is less than about 1% by constitutional mole, the pigment dispersibility becomes inferior, the emulsion particle diameter becomes larger and the toner diameter is difficult to control owing to aggregation in some cases. On the other hand, when it exceeds 20% by constitutional mole, the crystallinity of the polyester resin is deteriorated; the melting point decreases; the image storability is deteriorated; and the emulsion particle diameter becomes small enough to dissolve in water, resulting in incapability of latex formation in some cases.

A melting point of the crystalline polyester resin is preferably in a range of about 60 to 120° C., and more preferably in a range of about 70 to 100° C. When the melting point is less than 60° C., in some cases, powder easily aggregates, and the storability of fixed images deteriorates. On the other hand, when it exceeds about 120° C., the characteristics of the crystalline polyester resin deteriorate.

A melting point of the amorphous polyester resin is preferably in a range of about 50 to 100° C., and more preferably in a range of about 60 to 80° C. When the melting point is less than 50° C., in some cases, powder easily aggregates, and the storability of fixed images deteriorates. On the other hand, when it exceeds about 100° C., the characteristics of the crystalline polyester resin deteriorate.

Furthermore, in the polyester resin, a biodegradable polyester resin may be used.

Coloring Agent

A coloring agent of a toner according to the invention is not particularly limited. Conventionally-known coloring agents can be used and properly selected depending on the purposes. One kind of pigment may be used singularly, or two or more kinds of pigments of similar types may be blended and used in combination. Alternatively, two or more kinds of pigments formed from different base materials may be used in combinations. Specific examples of the coloring agents include carbon blacks such as a furnace black, channel black, acetylene black or thermal black; inorganic pigments such as a colcothar, aniline black, prussian blue, titanium oxide, or magnetic powder; azo pigments such as fast yellow, monoazo yellow, disazo yellow, pyrasolone Rred, chelate red, brilliant carmine (such as 3B or 6B) or para brown; phthalocyanine pigments such as copper phthalocyanine or non-metal phthalocyanine; and condensed polycyclic compound pigments such as a flavanthrone yellow, dibromoanthrone orange, perillene red, quinacridone red or dioxazine violet.

Examples of the coloring agent further include various kinds of pigments such as chrome yellow, hansa yellow, benzidine yellow, threne yellow, quinoline yellow, permanent orange GTR, pyrazolone orange, vulcan orange, watchyoung red, permanent red, Du Pont oil red, lithol red, rhodamine B lake, lake red C, rose bengal, aniline blue, ultramarine blue, chalco-oil blue, methylene blue chloride, phthalocyanine blue, phthalocyanine green, malachite green oxalate or para brown; and various kinds of dyes such as acridine dyes, xanthene dyes, azo dyes, benzoquinone dyes, azine dyes, anthraquinone dyes, dioxazine dyes, thiazine dyes, azomethine dyes, indigo dyes, thioindigo dyes, phthalocyanine dyes, aniline black dyes, polymethine dyes, triphenylmethane dyes, diphenylmethane dyes, thiazole dyes or xanthene dyes. A black color pigment or dye such as carbon black may be mixed with these coloring agents to an extent that does not deteriorates a transparency of a toner color. Furthermore, dispersion dyes, oil-soluble dyes and the like are also included in the examples of the coloring agent.

A content of the coloring agent in the electrophotographic toner according to the invention is preferably in a range of about 1 to 30 parts by mass to about 100 parts by mass of the binder resin, and is more preferably as large as possible in the above numerical range in a range that does not damage the smoothness of the image surface after fixation. When the content of the coloring agent is increased, in the case of forming images with the same density, a thickness of an image can be made thinner to effectively inhibit off-set from occurring. When the kinds of the coloring agents are properly selected, toners of various colors such as a yellow toner, a magenta toner, a cyan toner and a black toner can be obtained.

Mold Release Agent

Examples of typical mold release agents include low molecular weight polyethylenes, low molecular weight polypropylenes, Fischer-Tropsch wax, montan wax, carnauba wax, rice wax and candelilla wax.

Charge Control Agent

A charge control agent may be added to the toner according to the invention in a case it is needed. Conventionally-known charge control agents can be used as the charge control agent of the invention, and examples thereof include a cetyl pyridinium chloride, quaternary ammonium salts such as P-51 or P-53 (trade names, manufactured by Orient Chemical Industries, Ltd.), azo metal complexes such as S-44 or S-34 (trade names, manufactured by Orient Chemical Industries, Ltd.), salicylic acid metal complexes such as E84 (trade name, manufactured by Orient Chemical Industries, Ltd.), charge control agents containing resins having polar groups, dyes made of complexes such as aluminum complex, iron complex or chromium complex, triphenyl methane-based pigments, particles of metal oxides, and particles of metal oxides which are surface-treated with various kinds of silane coupling agents. When the toner is manufactured according to a wet process, from viewpoints of controlling of ionic strengths and reduction of wastewater contamination, materials which are difficult to dissolve in water are preferably used.

The toner according to the invention may be either of a magnetic toner that includes a magnetic material or a nonmagnetic toner that does not include a magnetic material.

The toner that is used in the invention can be manufactured by mixing particles of the toner and external additives described below by using a Henshel mixer or a V-blender. Furthermore, when toner particles are manufactured according to a wet process, the external additives can be added during the wet process.

Examples of lubricating particles added (externally added) to the toner that is used in the invention include solid lubricants such as a graphite, molybdenum disulfide, talc, aliphatic acids or metal salts of aliphatic acids; low molecular weight polyolefins such as polypropylene, polyethylene or polybuthene; silicone compounds that are softened by heating; fatty-acid amides such as oleic acid amide, erucic acid amide, ricinoleic acid amide, or stearic acid amide; plant waxes such as carnauba wax, rice wax, candelila wax, crude Japan wax, or jojoba oil; animal waxes such as bees wax; mineral and petroleum type waxes such as montan wax, ozocerite, ceresine, paraffin wax, microcrystalline wax, or Fischer-Tropsch wax; and modified ones thereof. These may be used singly or in combinations thereof. An average particle diameter of the lubricating particles is in a range of about 0.1 to 10 μm, and ones having any of the above-exemplified chemical structures may be pulverized and arranged so as to have an average particle diameter that is within the above-described range. An amount that is added to the toner is preferably in a range of about 0.05 to 2.0% by mass, and more preferably in a range of about 0.1 to 1.5% by mass based on the amount of the toner.

In order to remove accretions and deteriorated materials on a surface of the electrophotographic photoreceptor, inorganic particles, organic particles, composite particles obtained by adhering inorganic particles to the organic particles, and the like can be added to the toner that is used in the invention. Among these, the inorganic particles, which are excellent in polishing property, are particularly preferable. Examples of the inorganic particles include various kinds of inorganic oxides such as silica, alumina, titania, zirconia, barium titanate, aluminum titanate, strontium titanate, magnesium titanate, zinc oxide, chromium oxide, cerium oxide, antimony oxide, tungsten oxide, stannic oxide, tellurium oxide, manganese oxide, boron oxide, silicon carbide, boron carbide, titanium carbide, silicon nitride, titanium nitride or boron nitride; nitrides; and borides can be preferably used.

The above-described inorganic particles may be treated with titanium coupling agents such as tetrabutyl titanate, tetraoctyl titanate, isopropyltriisostearoyl titanate, isopropyltridecylbenzenesulfonyl titanate, and bis(dioctylpyrophosphate)oxyacetate titanate; or silane coupling agents such as γ-(2-aminoethyl)aminopropyltrimethoxysilane, γ-(2-aminoethyl)aminopropylmethyldimethoxysilane, γ-methacrlyloxypropyltrimethoxysilane, N-β-N-vinylbenzylaminoethyl) γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane or p-methylphenyltrimethoxysilane.

Furthermore, higher fatty acid metallic salts such as silicone oil, aluminum stearate, zinc stearate or calcium stearate are preferably applied to render hydrophobicity.

Examples of the organic particles include styrene resin particles, styrene-acrylic resin particles, polyester resin particles and urethane resin particles.

When the diameter of the particles is too small, the particles are deficient in polishing capability, and when the diameter of the particles is too large, scratches tend to occur on the surface of the electrophotographic photoreceptor. Accordingly, those having an average particle diameter in a range of about 5 to 1000 nm, preferably in a range of about 5 to 800 nm, and more preferably in a range of about 5 to 700 nm are used. Further, it is preferable that a sum of an amount of these particles and the addition amount of the above-described lubricating particles is about 0.6% by mass or more.

As other inorganic oxide that is added to the toner, a small diameter inorganic oxide having a primary particle diameter of about 40 nm or less is preferably added to improve a powder fluidity, charge control and the like. Furthermore, an inorganic oxide that has larger diameter than that of the small diameter inorganic oxide is preferably added in order to reduce an adhesive power and to perform charge control. Conventionally-known particles of inorganic oxides can be used as the "other inorganic oxide". Among them, in order to apply precise charge control, silica and titanium oxide are preferably used in combination. Furthermore, with regard to the small diameter inorganic particles, when the surface treatment is applied thereto, a dispersibility thereof can be enhanced, and as a result, an effect of improving a powder fluidity is enlarged.

Other Constituents

A surface of the electrophotographic toner of the invention may be covered with a surface layer. Preferably, the surface layer does not largely affect the mechanical characteristics and a melt viscoelasticity of the toner. For example, when a non-melting surface layer or a surface layer having high melting point thickly covers the toner, a low-temperature fixability due to the use of a crystalline polyester resin cannot be sufficiently exhibited even in a case when the crystalline polyester resin is used. Accordingly, a film thickness of the surface layer is preferably as thin as possible, and specifically, it is preferably in a range of about 0.001 to 0.5 μm.

In order to form such a thin surface layer having a thickness within the above-described range, a surface of the toner particle, that includes the binder resin and the coloring agents, and may further include the inorganic particles and other materials as needs arise, are preferably chemically treated. Examples of the components that constitute the thin surface layer by being chemically bonded to the materials existing on the surface of the toner particle include silane-coupling agents, isocyanates, and vinyl monomers. These components preferably have an introduced polar group in view of increasing adhesion intensity between the toner and a transfer receiving material such as paper.

As the polar group, any polar groups can be used as far as it is a functional group having polarity, and examples thereof include a carboxyl group, a carbonyl group, an epoxy group, an ether group, a hydroxy group, an amino group, an imino group, a cyano group, an amide group, an imide group, an ester group, and a sulfonic group. Examples of the methods of chemically treating include methods of oxidizing by use of strong oxidizing materials such as peroxide, ozone oxidation or plasma oxidation, and a method of binding a polymerizing monomer having a polar group by graft polymerization. By chemically treating the surface of the particle, the polar group can be strongly bonded to a molecule chain of the binder resin through a covalent bond.

In the invention, a charging material may be further chemically or physically adhered to a surface of the toner particle. Furthermore, particles of metal, metal oxides, metal salts, ceramics, resins or a carbon black may be externally added in order to improve ae chargeability, conductivity, powder fluidity or lubricity of the toner.

A volume average particle diameter of the electrophotographic toner of the invention is preferably in a range of about 1 to 20 μm and more preferably in a range of about 2 to 8 μm. A number average particle diameter of the electrophotographic toner of the invention is preferably in a range of about 1 to 20 μm and more preferably in a range of about 2 to 8 μm. The volume average particle diameter and the number average particle diameter can be obtained by measuring with a use of, for example, a Coulter counter (trade name: TYPE TA-II, manufactured by Beckman-Coulter Co., Ltd.) at an aperture diameter of 50 μm. At that time, a measurement is carried out after the toner is dispersed in an electrolyte aqueous solution (an Isoton-II aqueous solution) and further dispersed by applying ultrasonic wave for 30 seconds or more.

A method of manufacturing the electrophotographic toner of the invention explained above is not particularly restricted, but it is particularly preferable to use a manufacturing method of an electrophotographic toner according to the invention described below. Since the electrophotographic toner according to the invention has the above-described configuration, the toner is excellent in a toner-blocking resistance, an image storability and a low-temperature fixability. When the specific polyester resin (the crystalline polyester resin) is used and has a crosslinked structure by an unsaturated bond, the electrophotographic toner that has a wide fixing latitude to provide an excellent off-set resistance and can satisfactorily inhibit the toner from excessively penetrating into a recording medium such as paper. Furthermore, when a particle shape of the toner is made spherical, a transfer efficiency can be improved.

Two-Component Developer

Thus-obtained electrophotographic toner according to the invention can be used as a one-component developer as it is, or as a toner in a two-component developer according to the invention that is made of a carrier and the toner. Hereinafter, the two-component developer according to the invention will be explained.

The carrier that can be used in the two-component developer is not particularly limited, and conventionally-known carriers can be used. For example, a resin-coated carrier that has a resin cover layer on a surface of a core material can be used. Furthermore, a resin-dispersed carrier in which a conductive material is dispersed in a matrix resin may be used.

Examples of a resin that is used in the resin coating and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, straight silicone resins made of an organosiloxane bond or a modified material thereof, fluorinated resins, polyester, polycarbonate, phenolic resins and epoxy resins, but the resin is not limited thereto.

Examples of the electrical conductive material include metals such as gold, silver or copper, carbon black, titanium oxide, zinc oxide, barium sulfate, aluminum borate, potassium titanate, and tin oxide, is not limited thereto.

Examples of the core material of the carrier include magnetic metals such as iron, nickel or cobalt, magnetic oxides such as ferrite or magnetite, and glass beads. When the carrier is used in a magnetic brush method, magnetic materials are preferably used as the core material. A volume average particle diameter of the core material of the carrier is generally in a range of about 10 to 500 μm and preferably in a range of about 30 to 100 μm.

Examples of a method to coat a resin on a surface of a core material include a method in which the coating resin and, as needs arise, various kinds of additives are dissolved in an appropriate solvent to form a coating layer-forming solution and the solution is coated. The solvent is not particularly limited, and can be appropriately selected in consideration of the covering resin that is used, the coating aptitude and so on.

Examples of specific resin coating methods include a dipping method in which the core material of the carrier is dipped in a coating layer-forming solution, a spray method in which a coating layer-forming solution is sprayed on a surface of the core material of the carrier, a fluidized bed method in which a coating layer-forming solution is sprayed in a state where the core material of the carrier is floated by fluidizing air, and a kneader-coater method in which the core material of the carrier is mixed with a coating layer-forming solution in a kneader-coater, followed by removing a solvent.

A blending ratio (mass ratio) of the electrophotographic toner of the invention to the carrier in the two-component developer (toner: carrier) can be appropriately set; however, it is typically in a range of about 1:100 to 30:100, and preferably in a range of about 3:100 to 20:100.

Image Forming Method

Next, an image forming method according to the invention, which uses the electrophotographic toner according to the invention or the electrophotographic developer according to the invention, will be explained. The image forming method includes forming an electrostatic latent image on a surface of a latent image holder; developing, by use of a developer carried on a developer carrier, the electrostatic latent image formed on the surface of a latent image holder to form a toner image; transferring the toner image formed on the surface of the latent image holder onto a surface of a transfer receiving material such as paper; and thermally fixing the toner image transferred onto the surface of the transfer receiving material, in which as the developer the electrophotographic toner according to the invention or the electrophotographic developer according to the invention is used.

The developer may be either of a one-component developer and a two-component developer. In the case of the one-component developer, the electrophotographic toner according to the invention can be used as it is, and, in the case of the two-component developer, a two-component developer according to the invention in which the electrophotographic toner according to the invention and a carrier are blended is used. In any of the above steps, known steps in image forming methods can be utilized.

As the latent image holder, for example, an electrophotographic photoreceptor and a dielectric recording medium can be used. In the case of the electrophotographic photoreceptor, a surface of the electrophotographic photoreceptor is uniformly charged by use of a corotron electrifier, a contact electrifier, or the like, followed by exposure to form an electrostatic latent image (latent image forming process). Next, the electrophotographic photoreceptor is brought into contact with or proximity to a developing roll, on a surface of which a developer layer is formed, to adhere particles of the toner to the electrostatic latent image, and whereby a toner image is formed on the electrophotographic photoreceptor (developing process). The formed toner image is transferred onto a surface of a transfer receiving material such as paper or the like by use of the corotron electrifier or the like (transferring process). Furthermore, the toner image that is transferred onto the surface of the transfer receiving material is thermally fixed by use of a fixing device to form a final toner image. At the time of thermal fixing by use of the fixing device, in order to inhibit offset or the like from occurring, a mold releasing agent is usually supplied to a fixing member in the fixing device.

In the electrophotographic toner according to the invention (both here and below including the electrophotographic toner that is contained in the two-component developer according to the invention), when there is a crosslinking structure in the binder resin, the binder resin is excellent in the mold releasing property due to the effect thereof, accordingly, the fixing can be carried out with a reduced amount of a mold releasing agent or without using the mold releasing agent.

From the viewpoint of inhibiting oil from adhering to the transfer receiving material and the image after fixing, the mold releasing agent is preferably not used. However, in a case where an amount of the mold releasing agent that is supplied is set at 0 $mg/cm^2$, when the fixing member comes into contact with the transfer receiving material such as paper or the like at the time of fixing, in some cases, an amount of wear of the fixing member increases, and the durability of the fixing member is deteriorated. Consequently, from a practical point of view, it is preferable that the mold releasing agent is slightly supplied to the fixing member in a range of about $8.0\times10^{-3}$ $mg/cm^2$ or less.

When the amount of the mold releasing agent supplied exceeds $8.0\times10^{-3}$ $mg/cm^2$, the image quality is lowered because of the mold releasing agent adhered to the surface of the image after fixing. In particular, when transmission light is used such as in an OHP, this phenomenon may be apparent. Furthermore, in some cases, the adhesion of the mold releasing agent to the transfer receiving material becomes conspicuous and stickiness may be caused. Furthermore, the larger the amount of the mold releasing agent supplied, the larger a size of a tank that stores the mold releasing agent must be, resulting in enlargement of the size of the fixing device itself.

The mold releasing agent is not particularly limited, and examples thereof include liquid mold releasing agents such as a dimethyl silicon oil, fluorinated oil oil, fluorosilicon oil, and denatured oils such as an amino denatured silicon oil. Among them, from the viewpoint of attaching to the surface of the fixing member and forming a uniform mold releasing agent layer, the denatured oil such as an amino denatured silicon oil has excellent wettability to the fixing member and is accordingly preferable.

Furthermore, from the viewpoint of capability of forming a uniform mold releasing agent layer, a fluorinated oil and a fluorosilicon oil are preferable.

The use of a fluorinated oil or fluorosilicon oil as the mold releasing agent in conventionally-known image forming methods that do not use the electrophotographic toner according to the invention is not practical in view of cost, since an amount of the mold releasing agent supplied cannot be reduced therein. However, there is no practical problem in using the fluorinated oil or fluorosilicon oil in the case where the electrophotographic toner according to the invention is used from the viewpoint of the cost, since the amount of the mold releasing agent supplied can be dramatically reduced.

A method of supplying the mold releasing agent on a surface of a roller or belt that is a fixing member and is used for the thermocompression is not particularly limited. Examples of the methods include a pad method that uses a pad into which a liquid mold releasing agent is impregnated, a web method, a roll method, a non-contact shower method (spray method), and the like. Among these, the web method and the roll method are preferable.

When these methods are used, it is advantageous in that the mold releasing agent can be supplied uniformly and an amount supplied can be easily controlled. In order to supply the mold releasing agent uniformly onto the entire fixing member by means of the shower method, it is necessary to use a blade or the like separately.

An amount of the mold releasing agent supplied can be measured as follows. Namely, when plain paper that is used for an ordinary copy machine (as a typical example being a copy paper that is known by the trade name J PAPER, manufactured by Fuji Xerox Co., Ltd.) is passed through a fixing member on whose surface a mold releasing agent is supplied, the mold releasing agent adheres to the plain paper. The adhered mold releasing agent is extracted by use of a Soxhlet extractor. Here, hexane is used for a solvent. An amount of the mold releasing agent contained in the hexane is quantitatively determined with an atomic absorbance analyzer, whereby the amount of the mold releasing agent adhered to the plain paper can be quantitatively determined. The amount is defined as a supply amount of the mold releasing agent supplied to the fixing member.

Examples of the transfer receiving material onto which the toner image is transferred (recording material) include such as plain papers and OHP sheets that are used in an electrophotographic copy machine, an electrophotographic printer, or the like. In order to further improve a smoothness of the image surface after fixing, it is preferable that the surface of the transfer receiving material is also smoothened as far as possible. For example, coated papers in which a surface of a plain paper is coated with a resin or the like, art papers for printing, or the like can be preferably used.

When the image forming method that uses the electrophotographic toner according to the invention is used, aggregation of the toner does not occur. Accordingly, an image having excellent image quality can be formed, a low temperature fixation is possible, and image storability is excellent. Furthermore, when the binder resin has a crosslinking structure, adherence of the mold releasing agent to the transfer receiving material hardly occurs. As a result, when an image is formed by use of a transfer receiving material such as a seal and tape in which an adhesiveness is imparted to a rear side thereof, a seal, sticker or the like on which an image having high image quality and high density is formed can be manufactured.

Manufacturing Method of Electrophotographic Toner

As a manufacturing method of the electrophotographic toner according to the invention, a kneading pulverizing method and a wet granulation method can be used; however, the wet granulation method is more desirable. As the wet granulation method, known methods such as a melt suspension method, emulsion aggregation method and dissolution suspension method can be preferably used. From the viewpoint of easy control of a particle diameter and a shape of the toner, as a manufacturing method of the electrophotographic toner according to the invention, the emulsion aggregation method is preferable. Below, the emulsion aggregation method will be described as an example. The emulsion aggregation method includes dispersing (or emulsifying) in which a binder resin is dispersed (or emulsified) to form dispersed particles (or emulsified particles (liquid drops)); aggregating in which aggregates containing the dispersed particles (or emulsified particles (liquid droplets)) are formed; and fusing in which the aggregates are thermally fused.

As an example of manufacturing, by use of the emulsion aggregation method, an electrophotographic toner containing a binder resin and a coloring agent, a method in which a dispersion solution (including an emulsion solution) of particles of the binder resin and a dispersion solution of particles of the coloring agent are blended, whereby the particles of the binder resin and the particles of the coloring agent are aggregated, followed by heating to a temperature equal to or higher than the glass transition temperature or melting point of the binder resin to fuse the particles of the binder resin and the particles of the coloring agent can be used. The coloring agent can also be included during the dispersing or emulsifying of the particle dispersion solution (including the emulsifying solution) of the binder resin. When the coloring agent is included during the dispersing (emulsifying) (hereinafter simply referred to as dispersing), the blending of the polymer and the coloring agent can be carried out by blending the coloring agent or an organic solvent dispersion solution of the coloring agent in an organic solvent solution of the polymer.

Hereinafter, a case where a particle dispersion solution of the binder resin (It including the emulsifying solution; hereinafter collectively referred to as a "particle dispersion solution") and a particle dispersion solution of the coloring agent are separately prepared will be explained.

Preparation of Particle Dispersion Solution of Polyester Resin

A particle dispersion solution of a polyester resin can be formed by applying a shearing force to a liquid in which a water-based medium and a sulfonated polyester resin are blended.

At that time, the viscosity of the polymer solution can be lowered when the polyester resin is heated or dissolved in an organic solvent, whereby emulsified particles can be formed. Furthermore, in order to stabilize the emulsified particles and to increase the viscosity of the water-based medium, a dispersing agent may be used.

Examples of the dispersing agent include: water-soluble polymers such as polyvinyl alcohol, methyl cellulose, ethyl cellulose, hydoxyethyl cellulose, carboxymethyl cellulose, polysodium acrylate or polysodium methacrylate; surfactants such as anionic surfactants such as sodium dodecylbenzenesulfonate, sodium octadecylsulfate, sodium oleate, sodium laurate or potassium stearate; cationic surfactants such as laurylamine acetate, stearylamine acetate or lauryltrimethylammonium chloride; amphoteric surfactants such as lauryldimethylamine oxide; nonionic surfactants such as polyoxyethylene alkyl ether, polyoxyethylene alkylphenylether or polyoxyethylene alkylamine; and inorganic compounds such as tripotassium phosphate, aluminum hydroxide, calcium sulfate, calcium carbonate or barium carbonate.

In the case where an inorganic compound is used as the dispersing agent, commercially-available inorganic compounds may be directly used. Alternatively, in order to obtain particles, a method of producing particles of an inorganic compound in a dispersing agent may be adopted. An amount of the dispersing agent used is preferably in a range of about 0.01 to 20 parts by mass based on 100 parts by mass of the polyester resin (binder resin).

During the above-described dispersing, when a dicarboxylic acid having a sulfonic acid group is copolymerized in the polyester resin (namely, when an appropriate amount of a dicarboxylic acid having a sulfonic acid group-derived constituent is contained in the acid-derived constituent), an addition amount of a dispersion stabilizer such as surfactants can be reduced, or addition of the dispersion stabilizer can be omitted.

Examples of the organic solvent include ethyl acetate and toluene, and the kind of the organic solvent can be appropriately selected in accordance with a property of the polyester resin.

An amount of the organic solvent used is preferably in a range of about 50 to 5000 parts by mass and more preferably in a range of about 120 to 1000 parts by mass based on a total amount of 100 parts by mass of the polyester resin and other monomers which are added as needs arise (hereinafter, in some cases, the polyester resin and other monomers which are added as needs arise is simply referred to as a "polymer"). Before the emulsified particles are formed, a coloring agent may be blended therein. The coloring agent that is used is previously described in the paragraph of the "Coloring Agent" in the specification of the invention.

Examples of a dispersing (or emulsifying) machine that is used to form the emulsified particles include a homogenizer, a homo-mixer, a compressing kneader, an extruder and a media-dispersing machine. With regard to a size of the dispersed particles (liquid droplets) of the polyester resin, an average particle diameter (volume-averaged particle diameter) thereof is preferably in a range of about 0.01 to 1 μm, more preferably in a range of about 0.03 to 0.4 μm, and still more preferably in a range of about 0.03 to 0.3 μm.

Preparation of Coloring Agent Particle Dispersion Solution

A method of dispersing the coloring agent is not particularly limited, and examples thereof include arbitrary methods such as a general dispersing method that uses means such as a rotary shearing homogenizer, and mills such as a ball mill, a sand mill or a dynomill having media. As needs arise, a surfactant can be used to prepare an aqueous dispersion solution of the coloring agent, or a dispersing agent can be used to prepare an organic solvent dispersion solution of the coloring agent. As the surfactants or the dispersing agents that are used for dispersing, ones that are similar to dispersing agents that can be used to disperse the polyester resin can be used.

An amount of the coloring agent that is to be added is preferably in a range of about 1 to 20% by mass, more preferably in a range of about 1 to 10% by mass, still more preferably in a range of about 2 to 10% by mass, and particularly preferably in a range of about 2 to 7% by mass with respect to a total amount of the polymer. When the coloring agent is added during emulsifying, the polymer can be blended with the coloring agent by blending the coloring agent or the organic solvent dispersion solution of the coloring agent with the organic solvent solution of the polymer.

Aggregating

In the aggregating, the particle dispersion solution of the binder resin and the particle dispersion solution of the coloring agent are blended, and preferably heated at a temperature near the melting point of the polyester resin contained as the binder resin and equal to or less than the melting point to form aggregates. When the pH of the dispersion solution is rendered acidic under agitation, the aggregates are generated. The pH is preferably in a range of about 2 to 6, more preferably in a range of about 2.5 to 5 and still more preferably in a range of about 2.5 to 4. At this time, a flocculant can be effectively used.

As the flocculant that is used, other than surfactants having a polarity opposite to that of the surfactant that is used in the dispersing agent and inorganic metal salts, divalent or higher metal complexes can be preferably used. When the metal complex is used, it is particularly preferable because an amount of the surfactant used can be reduced and the charging characteristics can be improved.

Examples of the inorganic metal salts include metal salts such as calcium chloride, calcium nitrate, barium chloride, magnesium chloride, zinc chloride, aluminum chloride, or aluminum sulfate; inorganic metal salt polymers such as polyaluminum chloride, polyaluminum hydroxide or polycalcium sulfide; and so on can be used. Among these, in particular, aluminum salts and polymers thereof are preferably used. In order to obtain a sharper (narrower) particle size distribution, a valence of the inorganic metal salt is more preferably bivalent than monovalent, more preferably trivalent than bivalent, and more preferably tetravalent than trivalent. Further, among inorganic metal salts having the same valence, an inorganic metal salt of a polymerization type is more preferable.

Fusing

In the fusing, under agitation similar to that in the aggregating, the pH of a suspension solution of the aggregates is controlled in a range of about 3 to 7 to stop the aggregating, followed by heating to a temperature equal to or greater than the melting point of the polyester resin to fuse the aggregates. As far as the temperature of the heating is equal to or greater than the melting point of the polyester resin, there is no problem with regard to the temperature of the heating. The heating is continued for a length of time allowing sufficient fusing, that is, about 0.5 to 10 hrs.

Fused particles obtained by the fusing undergo a solid-liquid separation process such as filtration, and, as necessary, a cleaning process and a drying process, to become toner particles. In this case, in order to secure charging characteristics and reliability that are sufficient for toner, it is preferable that in the cleaning process, the cleaning is sufficiently applied. In the drying process, an arbitrary method such as an ordinary vibration type fluidized drying method, a spray drying method, a freeze-drying method or a flash jet method can be adopted. The toner particles are preferably adjusted so as to have a water content after drying of about 1.0% by mass or less, and more preferably about 0.5% by mass or less.

In the fusing step, a crosslinking reaction may be effected during heating the polyester resin at the temperature equal to or greater than the melting point of the polyester resin or after the completion of the fusion. The crosslinking reaction may also be effected simultaneously with the aggregation. In the case where the crosslinking reaction is effected, for example, an unsaturated sulfonated crystalline polyester resin copolymerized with a double bond component is used as the binder resin, and the resin is subjected to a radical reaction to introduce a crosslinked structure. At this time, a polymerization initiator shown below may be used.

Examples of the polymerization initiator include t-butyl peroxy-2-ethylhexanoate, cumyl perpivalate, t-butyl peroxylaurate, benzoyl peroxide, lauroyl peroxide, octanoyl peroxide, di-t-butyl peroxide, t-butylcumyl peroxide, dicumyl peroxide, 2,2'-asobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy)hexane, di-t-butyldiperoxy isophthalte, 2,2-bis(4,4-di-t-butylperoxycyclohexyl)propane, di-t-butylperoxy-α-methyl succinate, di-t-butylperoxydimethyl glutarate, di-t-butylperoxy hexahydroterephtalate, di-t-butylperoxy azelate, 2,5-dimethyl-2,5-di(t-butylperoxy)hexane, diethylene glycol-bis(t-butylperoxycarbonate), di-t-butylperoxytrimethyl adipate, tris(t-butylperoxy)triazine, vinyl tris(t-butylperoxy)silane, 2,2'-azobis(2-methylpropionic amidine dihydrochloride), 2,2'-azobis[N-(2-carboxyethyl)-2-methylpropionic amidine] and 4,4'-azobis(4-cyanovaleric acid).

These polymerization initiators may be used singly or in combinations of two or more of them. The amount and the kind of the polymerization initiator are selected depending on an amount of an unsaturated part in the polymer, and a kind and an amount of the coexisting coloring agent. The polymerization initiator may be mixed with the polymer prior to dispersing, or, may be incorporated in the aggregates in during aggregating. Furthermore, it may be introduced during fusing or after fusing. In the case where it is introduced during aggregating, during fusing or after the fusing, a liquid obtained by dissolving or dispersing the polymerization initiator therein is added to the particle dispersion solution (such as the resin particle dispersion solution). The polymerization initiator may contain a known additive, such as a crosslinking agent, a chain transfer agent or a polymerization inhibitor, for a purpose of controlling a degree of polymerization.

Hereinafter, particularly preferable modes of the invention are listed. However, the invention is not necessarily limited to these modes.

[1] A binder resin, comprising a rare earth element in a range of about 1 to 10000 ppm.

[2] A binder resin described in the preferred mode [1], comprising a polyester resin containing a rare earth element in a range of about 1 to 10000 ppm.

[3] A binder resin described in the preferred mode [1], wherein the rare earth element is Sc, Y, Yb or Sm.

[4] A binder resin described in the preferred mode [1], wherein the binder resin is synthesized by use of a catalyst represented by the following formula (1).

$$X(OSO_2CF_3)_3 \qquad \text{Formula (1)}$$

In the formula (1), X represents Sc, Y, Yb or Sm.

[5] A binder resin described in the preferred mode [1], wherein the binder resin is synthesized by use of a catalyst represented by the following formula (2).

$$X(N(SO_2CF_3)_2)_3 \qquad \text{Formula (2)}$$

In the formula (2), X represents Sc, Y, Yb or Sm.

[6] An electrophotographic toner comprising a binder resin and a coloring agent, wherein the binder resin is any one of those described in the preferred modes [1] to [5].

[7] A manufacturing method of an electrophotographic toner comprising:

emulsifying a binder resin to prepare emulsified particles of the binder resin;

aggregating to form aggregates containing the emulsified particles of binder resin; and fusing the aggregates, wherein the binder resin is any one of those described in the preferred modes [1] to [5].

[8] An electrophotographic developer comprising an electrophotographic toner and a carrier, wherein the electrophotographic toner is the electrophotographic toner described in the preferred mode [6].

[9] An image forming method comprising:

forming an electrostatic latent image on a surface of a latent image holder;

developing, by use of a developer carried on a developer carrier, the electrostatic latent image formed on the surface of a latent image holder to form a toner image;

transferring the toner image formed on the surface of the latent image holder on a surface of a transfer receiving material; and thermally fixing the toner image transferred onto the surface of the transfer receiving material, wherein the developer is the electrophotographic toner described in the preferred mode [6] or the electrophotographic developer described in the preferred mode [8].

[10] An electrophotographic toner comprising a binder resin and a coloring agent, wherein the binder resin comprises a polyester resin synthesized with a non-homogeneous catalyst in which a rare earth metal triflate or a rare earth metal triflylimide is carried on a carrier.

[11] A polyester resin for use in an electrophotographic toner, the polyester resin being synthesized from acid units having dicarboxylic acid groups and alcohol units having diol groups, wherein the polyester resin is synthesized with a nonhomogeneous catalyst in which a rare earth metal triflate or a rare earth metal triflylimide is carried on a carrier.

[12] A polyester resin for use in an electrophotographic toner described in the preferred mode [11], wherein the polyester resin is crystalline.

[13] A polyester resin for use in an electrophotographic toner described in the preferred mode [11], wherein the rare earth metal triflate is represented by $X(OSO_2CF_3)_3$ (in which X represents a rare earth element).

[14] A polyester resin for use in an electrophotographic toner described in the preferred mode [11], wherein the rare earth metal triflylimide is represented by $X(N(OSO_2CF_3)_2)_3$ (in which X represents a rare earth element).

[15] A method of manufacturing a polyester resin for use in an electrophotographic toner comprising synthesizing a polyester resin from acid units having dicarboxylic acid groups and alcohol units having diol groups, wherein, as a synthesis catalyst, a non-homogeneous catalyst in which a rare earth metal triflate or a rare earth metal triflylimide is carried on a carrier is used in the synthesizing.

[16] A method of manufacturing a polyester resin for use in an electrophotographic toner described in the preferred mode [15], further comprising dissolving the polyester resin in a solvent that dissolves the polyester resin after the synthesis, and recovering, from an obtained solution, the non-homogeneous catalyst in which a rare earth metal triflate or a rare earth metal triflylimide is carried on a carrier.

[17] A method of manufacturing an electrophotographic toner comprising:

blending a particle dispersion solution of a binder resin and a particle dispersion solution of a coloring agent to aggregate particles of the binder resin and particles of the coloring agent; and heating the aggregated particles to a temperature equal to or greater than a glass transition temperature or a melting point of the binder resin to fuse the aggregated particles, wherein the binder resin comprises a polyester resin for use in an electrophotographic toner, the polyester resin being synthesized with a non-homogeneous catalyst in which a rare earth metal triflate or a rare earth metal triflylimide is carried on a carrier.

[18] An electrophotographic developer for use in electrophotographic toner comprising a carrier and a toner, wherein the toner comprises at least a binder resin and a coloring agent, and the binder resin comprises a polyester resin that is synthesized with a non-homogeneous catalyst in which a rare earth metal triflate or a rare earth metal triflylimide is carried on a carrier.

[19] An image forming method comprising:

forming an electrostatic latent image on a surface of a latent image holder;

developing, by use of a developer carried on a developer carrier, the electrostatic latent image formed on the surface of a latent image holder to form a toner image;

transferring the toner image formed on the surface of the latent image holder onto a surface of a transfer receiving material; and thermally fixing the transferred toner image on the surface of the transfer receiving material, wherein the developer comprises a carrier and a toner; the toner comprises at least a binder resin and a coloring agent; and the binder resin comprises a polyester resin that is synthesized with a non-homogeneous catalyst in which a rare earth metal triflate or a rare earth metal triflylimide is carried on a carrier.

EXAMPLES

In what follows, examples according to the present invention will be explained. However, the invention is not restricted to the examples. In what follows, "parts" means "parts by mass" and "%" means "% by mass". An average particle diameter of the toner particles is measured by use of a Coulter counter (trade name: TYPE TA-II, manufactured by Beckman Coulter Co., Ltd.). Average particles diameters of the resin particles, the coloring agent and the mold releasing agents are measured by use of a laser diffraction type particle size distribution analyzer (trade name: LA-700, manufactured by Horiba Co., Ltd.).

Weight-average molecular weights (Mw) of resins in the resin particles and the toner particles are measured by a gel-permeation chromatography device (trade name: HLC-8120GPC, manufactured by Tosoh Corporation).

Fluorescence intensity of a toner obtained is measured by use of fluorescent x-ray to measure rare earth elements (scandium and yttrium). From a calibration curve separately prepared, amounts of rare earth elements contained in the toner are calculated.

The chargeabiliy is evaluated as follows. To an electrophotographic toner, 0.8% by mass of silica particles that are surface-treated to be hydrophobic and have a primary particle diameter of 40 nm (hydrophobic silica, trade name: RX50, manufactured by Nippon Aerosil Co., Ltd.) and 1.0% by mass of particles of a metatitanate compound (one obtained by processing 100 parts by mass of metatitanic acid and 50 parts by mass of isobutyl trimethoxysilane) that is a reaction product of metatitanic acid and isobutyl trimethoxysilane and has a primary average particle diameter of 20 nm are added and blended, whereby an electrophotographic toner for use in external addition is prepared. Into a V-blender, 8 parts by mass of the electrophotographic toner for use in external addition and 92 parts by mass of a methyl methacrylate resin-coated carrier are introduced and agitated for 20 mins, followed by charging into a developer of a full-color copy machine (trade name: A COLOR 935, manufactured by Fuji Xerox Co., Ltd.), and, after setting-up, a charge amount is measured (a mesh opening of 20 μm is used) by use of a blow-off charge amount measuring device (manufactured by Toshiba Corp.). When the charge amount is in a range of about 10 to 40 μC/g, it is judged to be acceptable, and, when it is outside of the range, it is judged to be unacceptable.

The charge amount is measured under two conditions of 30° C. and RH80% (A-zone), and 10° C. and RH15% (C-zone).

Example 1-1

Synthesis of Crystalline Polyester Resin 1-(1)

Two hundred parts of 1,9-nonanediol, 260 parts of didodecane dionic acid, 7.4 parts of 5-sulfoisophthalic acid dimethyl ester, 21 parts of 5-t-butyl isophthalic acid and 12.6 parts of scandium triflate as a catalyst are blended in a flask, and after nitrogen substitution is applied, a temperature is raised to 100° C. to dissolve the same. With the temperature kept at 100° C., the flask, under stirring, is depressurized over 1 hr to a pressure of 20 mm Hg. Furthermore, the pressure is further lowered to 10 mm Hg or less, followed by continuing a reaction for 7 hrs as it is, whereby a resin is obtained. A weight-average molecular weight (Mw) is 20000.

Manufacture of Electrophotographic Toner 1-(1)

In an emulsifying device (trade name: ULTRA-TURRAX®, manufactured by Junke and Kunkel IKA Labortechnic), 10 parts by mass of the obtained crystalline polyester resin 1-(1) and 90 parts by mass of distilled water are stirred at 95° C. and centrifuged at 10000 rpm for 3 mins to emulsify, whereby an emulsion is obtained. To 100 parts by mass of the emulsion, 4 parts by mass of copper phthalocyanine pigment (C.I.Pigment Blue 15:3) dispersion solution (0.4 parts by mass as a solid content) is added, and, under stirring, 10 g of 1 mass % aluminum sulfate aqueous solution is slowly added to perform aggregation. After the solution is stirred at 60° C. for 2 hrs, the pH thereof is controlled to 4.5, followed by further gradual heating, and at 95° C. heating and stirring are carried out at 95° C. for 20 mins. Thereafter, the solution is cooled in air, and cleaning is applied with ion-exchange water, followed by freeze-drying, whereby an electrophotographic toner 1-(1) is manufactured.

An average particle diameter of the obtained electrophotographic toner is measured by use of a Coulter counter (trade name: TYPE TA-II, aperture diameter: 50 μm, manufactured by Coulter Counter Co., Ltd.) and found to be 5.8 μm. When the toner is observed with an optical microscope, a spherical particle shape is confirmed.

Example 1-2

Synthesis of Crystalline Polyester Resin 1-(2)

Crystalline polyester resin 1-(2) is prepared in a similar manner as in the synthesis of the crystalline polyester resin 1-(1) in Example 1-1, except in that the catalyst is changed to 0.126 parts of scandium triflate, a resin constitution is made similar to example 1-1. A weight-average molecular weight (Mw) thereof is 21000.

Manufacture of Electrophotographic Toner 1-(2)

Electrophotographic toner 1-(2) is prepared in a similar manner as in the "manufacture of electrophotographic toner (1)" in Example 1-1, except that a polyester resin is changed to the crystalline polyester resin 1-(2).

An average particle diameter of the thus obtained electrophotographic toner is measured by use of a Coulter counter (trade name: TYPE TA-II, aperture diameter: 50 μm, manufactured by Coulter Counter Co., Ltd.) and found to be 5.7 μm. When the toner is observed with an optical microscope, a spherical particle shape is confirmed.

Example 1-3

Synthesis of Crystalline polyester Resin 1-(3)

Crystalline polyester resin 1-(3) is prepared in a similar manner as in the synthesis of the crystalline polyester resin 1-(1) in Example 1-1, except in that the catalyst is changed to 5.6 parts of scandium triflate. A weight-average molecular weight (Mw) thereof is 19000.

Manufacture of Electrophotographic Toner 1-(3)

Electrophotographic toner 1-(3) is prepared in a similar manner as in the "manufacture of electrophotographic toner 1-(1)" in Example 1-1, except that a polyester resin is changed to the crystalline polyester resin 1-(3).

An average particle diameter of the thus-obtained electrophotographic toner is measured by use of a Coulter counter (trade name: TYPE TA-II, aperture diameter: 50 μm, manufactured by Coulter Counter Co., Ltd.) and is found to be 6.5 μm. When the toner is observed with an optical microscope, a spherical particle shape is confirmed.

Example 1-4

Synthesis of Crystalline Polyester Resin 1-(4)

Crystalline polyester resin 1-(4) is prepared in a similar manner as in the synthesis of crystalline polyester resin 1-(1) in Example 1-1, except that a resin constitution is changed to 301 parts by mass of dimethyl terephthalate and 248 parts by mass of 1,9-nonanediol, and a catalyst is changed to 12.6 parts of scandium triflate. A weight-average molecular weight (Mw) thereof is 19000.

Manufacture of Electrophotographic Toner 1-(4) (Dissolution Suspension Method)

Twenty-eight parts by mass of the crystalline polyester resin 1-(4), 5 parts by mass of copper phthalocyanine pigment (C.I. Pigment Blue 15:3) and 60 parts by mass of toluene are dispersed by means of a sand mill to prepare a dispersion solution. To 36 parts by mass of a 3.0% by mass carboxylmethyl cellulose aqueous solution, 45 parts of a 40% by mass calcium carbonate suspension solution and 45 parts by mass of water are added. Thereto, the whole of the dispersion solution is added at 50° C., followed by suspending by stirring at 50° C. and 10000 rpm for 3 mins by use of an emulsifying device (trade name: ULTRA-TURRAX, manufactured by Junke and Kunkel IKA Labortechnic), whereby a suspension solution is obtained.

Subsequently, under nitrogen flow, toluene and water are vaporized as far as possible, whereby a cross-linked particle dispersion solution is obtained. To the obtained cross-linked particle dispersion solution, water of an amount of about 5 times that of the cross-linked particle dispersion solution is added, calcium carbonate is dissolved with hydrochloric acid, water-washing is repeated, finally followed by depressing and freeze-drying, whereby an electrophotographic toner 1-(4) is manufactured.

An average particle diameter of the obtained electrophotographic toner is measured by use of a Coulter counter (trade name: TYPE TA-II, aperture diameter: 50 μm, manufactured by Coulter Counter Co., Ltd.) and is found to be 6.3 μm. When the toner is observed with an optical microscope, a spherical particle shape is confirmed.

Example 1-5

Synthesis of Crystalline Polyester Resin 1-(5)

Crystalline polyester resin 1-(5) is prepared in a similar manner as in the synthesis of crystalline polyester resin 1-(1) in Example 1-1, except in that the catalyst is changed to 12.6 parts of scandium triflylimide. A weight-average molecular weight (Mw) thereof is 18000.

Manufacture of Electrophotographic Toner 1-(5)

Electrophotographic toner 1-(5) is prepared in a similar manner as in the "manufacture of electrophotographic toner (1)" in Example 1-1, except that a polyester resin is changed to the crystalline polyester resin 1-(5).

An average particle diameter of the thus obtained electrophotographic toner is measured by use of a Coulter counter (trade name: TYPE TA-II, aperture diameter: 50 μm, manufactured by Coulter Counter Co., Ltd.) and found to be 6.5 μm. When the toner is observed with an optical microscope, a spherical particle shape is confirmed.

Example 1-6

Synthesis of Crystalline Polyester Resin 1-(6)

Crystalline polyester resin 1-(6) is prepared in a similar manner as in the synthesis of crystalline polyester resin 1-(1) in Example 1-1, except in that the catalyst is changed to 12.6 parts of yttrium triflate, a resin constitution is made similar to example 1-1. A weight-average molecular weight (Mw) thereof is 19000.

Manufacture of Electrophotographic Toner 1-(6)

Electrophotographic toner 1-(6) is prepared in a similar manner as in the "manufacture of electrophotographic toner 1-(1)" in Example 1-1, except that a polyester resin is changed to the crystalline polyester resin 1-(6).

An average particle diameter of the obtained electrophotographic toner is measured by use of a Coulter counter (trade name: TYPE TA-II, aperture diameter: 50 μm, manufactured by Coulter Counter Co., Ltd.), and found to be 6.5 μm. When the toner is observed with an optical microscope, a spherical particle shape is confirmed.

Example 1-7

Synthesis of Crystalline Polyester Resin 1-(7)

Crystalline polyester resin 1-(7) is prepared in a similar manner as in the synthesis of crystalline polyester resin 1-(1) in Example 1-1, except that a resin constitution is changed to 200 parts of 1,6-hexanediol, 260 parts of 1,9-nonanedicarboxylic acid and 7.4 parts of 5-sulfoisophthalic acid dimethyl ester. A weight-average molecular weight (Mw) thereof is 19000.

Manufacture of Electrophotographic Toner 1-(7)

Electrophotographic toner 1-(7) is prepared in a similar manner as in the "manufacture of electrophotographic toner 1-(1)" in Example 1-1, except that a polyester resin is changed to the crystalline polyester resin 1-(7).

An average particle diameter of the obtained electrophotographic toner is measured by use of a Coulter counter (trade name: TYPE TA-II, aperture diameter: 50 μm, manufactured by Coulter Counter Co., Ltd.), and found to be 6.5 μm. When the toner is observed with an optical microscope, a spherical particle shape is confirmed.

Comparative Example 1-1

Synthesis of Crystalline Polyester Resin 1-(8)

Crystalline polyester resin 1-(8) is prepared in a similar manner as in the synthesis of crystalline polyester resin 1-(1) in Example 1-1, except in that the catalyst is changed to 0.03 parts of scandium triflate. A weight-average molecular weight (Mw) thereof is 15000.

Manufacture of Electrophotographic Toner 1-(8)

Electrophotographic toner 1-(8) is prepared in a similar manner as in the "manufacture of electrophotographic toner 1-(1)" in Example 1-1, except that a polyester resin is changed to the crystalline polyester resin 1-(8).

An average particle diameter of the obtained electrophotographic toner is measured by use of a Coulter counter (trade name: TYPE TA-II, aperture diameter: 50 μm, manufactured by Coulter Counter Co., Ltd.) and found to be 5.7 μm. When the toner is observed with an optical microscope, a spherical particle shape is confirmed.

Comparative Example 1-2

Synthesis of Crystalline Polyester Resin 1-(9)

Crystalline polyester resin 1-(9) is prepared in a similar manner as in the synthesis of crystalline polyester resin 1-(1) in Example 1-1, except in that the catalyst is changed to 50 parts of scandium triflate. A weight-average molecular weight (Mw) thereof is 20000.

Manufacture of Electrophotographic Toner 1-(9)

Electrophotographic toner 1-(9) is prepared in a similar manner as in the "manufacture of electrophotographic toner 1-(1)" according to example 1-1, except that a polyester resin is changed to the crystalline polyester resin 1-(9).

An average particle diameter of the obtained electrophotographic toner is measured by use of a Coulter counter (trade name: TYPE TA-II, aperture diameter: 50 μm, manufactured by Coulter Counter Co., Ltd.) and found to be 5.8 μm. When the toner is observed with an optical microscope, a spherical particle shape is confirmed.

Comparative Example 1-3

Synthesis of Crystalline Polyester Resin 1-(10)

Crystalline polyester resin 1-(10) is prepared in a similar manner as in the synthesis of the crystalline polyester resin 1-(1) in Example 1-1, except for a catalyst being changed to 0.2 parts of tetra-n-butyl titanate. After the nitrogen substitution is applied, stirring is applied at a reaction temperature of 180° C. for 3 hrs, followed by polymerizing under reduced pressure for 5 hrs. Thereafter, over 4 hrs, a temperature is finally elevated to 220° C., and finally a reaction is performed for 12 hrs in total to synthesize a resin. A weight-average molecular weight (Mw) is 25000.

Manufacture of Electrophotographic Toner 1-(10)

Electrophotographic toner 1-(10) is prepared in a similar manner as in the "manufacture of electrophotographic toner 1-(1)" in Example 1-1, except that a polyester resin is changed to the crystalline polyester resin 1-(10).

An average particle diameter of the obtained electrophotographic toner is measured by use of a Coulter counter (trade name: TYPE TA-II, aperture diameter: 50 μm, manufactured by Coulter Counter Co., Ltd.) and found to be 6.5 μm. When the toner is observed with an optical microscope, a spherical particle shape is confirmed.

An evaluation of an electrophotographic developer is carried out as follows. That is, with an external addition electrophotographic toner for use in and by use of a modified digital color copy machine (trade name: DOCU CENTRE COLOR 500CP, manufactured by Fuji Xerox Co., Ltd.), image formation is carried out, and the respective images of an initial image ($10^{th}$ image) and $50000^{th}$ image are visually observed for image quality stability (fusion irregularity) and contamination of the background.

Image quality evaluation and background contamination are evaluated according to evaluation criteria below.

A: There is no problem with respect to the image.

B: Although a little contamination is observed, there is no practical problem.

C: Since significant contamination is observed, the image cannot be practically used.

Furthermore, an overall evaluation of the electrophotographic toner is carried out according to the evaluation criteria below.

A: There is no problem.

B: Although a little contamination is observed, there is no practical problem.

C: Since significant contamination is observed, the image cannot be practically used.

These evaluations are summarized in Table 1.

TABLE 1

| | Content of rare earth element (ppm) | Chargeability 30° C. RH 80% | Chargeability 10° C. RH 15% | Image quality stability Initial ($10^{th}$) | Image quality stability $50000^{th}$ | Contamination of background Initial ($10^{th}$) | Contamination of background $50000^{th}$ | Overall evaluation |
|---|---|---|---|---|---|---|---|---|
| Example 1-1 | 2200 (Sc) | A | A | A | A | A | A | A |
| Example 1-2 | 1.5 (Sc) | A | A | A | A | A | A | A |
| Example 1-3 | 30 (Sc) | A | A | A | A | A | A | A |
| Example 1-4 | 2000 (Sc) | A | A | A | A | A | A | A |
| Example 1-5 | 1800 (Sc) | A | A | A | A | A | A | A |
| Example 1-6 | 1600 (Y) | A | A | A | A | A | A | A |
| Example 1-7 | 1800 (Sc) | A | A | A | A | A | A | A |
| Comparative example 1-1 | 0.02 (Sc) | A | A | A | C | C | C | C |
| Comparative example 1-2 | 12000 (Sc) | C | A | A | C | C | C | C |
| Comparative example 1-3 | — | C | C | A | C | A | C | B |

As is apparent from Table 1, the electrophotographic toners according to the invention have less environmental dependency with regard to the charge amount.

Example 2-1

Synthesis of Crystalline Polyester Resin 2-(1)

Two hundred parts of 1,9-nonanediol, 260 parts of didodecane dionic acid, 7.4 parts of 5-sulfoisophthalic acid dimethyl ester, 21 parts of 5-t-butyl isophthalic acid and 20 parts of micro-encapsulated scandium triflate (scandium trifluoromethane sulfonate) (trade name: SCANDIUM TRIFLUOROMETHANESULFONATE, MICROENCAPSULATED, CARRIER: POLYSTYRENE, manufactured by Wako Pure Chemical Industries, Ltd.) as a non-homogeneous catalyst are blended in a flask, after nitrogen substitution is applied, a temperature is elevated to 100° C. to dissolve. With the temperature kept at 100° C., the flask, under stirring, is depressurized over 1 hr to a pressure of 20 mm Hg. Furthermore, a reaction is continued for 7 hrs as it is, whereby a crystalline polyester resin 2-(1) is obtained. The melting point is 68° C.

Recovery of Catalyst and Polyester Resin

The crystalline polyester resin 2-(1) obtained as described above is dissolved in chloroform. The dissolved one is centrifuged to filtrate whereby a crystalline polyester 2-(1) and the catalyst are separated. A chloroform filtrate is dropped in hexane to recover the crystalline polyester resin 2-(1). Furthermore, the catalyst is dried in a vacuum and recovered after washing with chloroform and filtrating.

Manufacture of Electrophotographic Toner

In an emulsifying device (trade name: ULTRA-TURRAX®, manufactured by Junke and Kunkel IKA Labortechnic), 10 parts of the crystalline polyester resin 2-(1) and 90 parts of distilled water are stirred at 95° C. and 10000 rpm for 3 mins to emulsify, whereby an emulsion is obtained. To 100 parts of the emulsion, 4 parts of copper phthalocyanine pigment (C.I.Pigment Blue 15:3) dispersion solution (0.4 parts as a solid content) is added, and, under stirring, 10 g of a 1% aluminum sulfate aqueous solution is slowly added to perform aggregation. The solution is stirred at 60° C. for 2 hrs, the pH thereof is controlled to 4.5, followed by gradually heating, and at 95° C. the heating and stirring are carried out for 20 mins. Thereafter, the solution is cooled in air, the cleaning is applied with ion-exchange water, followed by freeze-drying, whereby an electrophotographic toner 2-(1) is manufactured. Of the obtained electrophotographic toner, an average particle diameter is measured by use of a Coulter counter (trade name: TYPE TA-II, aperture diameter: 50 μm, manufactured by Coulter Counter Co., Ltd.) and an average particle diameter of the obtained toner particles is found to be 5.7 μm. When the toner is observed with an optical microscope, a spherical particle shape is confirmed.

Example 2-2

Synthesis of Crystalline Polyester Resin 2-(2)

Crystalline polyester resin 2-(2) is prepared in a similar manner as in the synthesis of crystalline polyester resin 2-(1) in Example 2-1, except that a use amount of microencapsulated scandium triflate that is a non-homogeneous catalyst is changed to 10 parts. Carboxylic acid and alcohol which are similar to those in Example 2-1 are used. After nitrogen substitution is carried out, a temperature is elevated to 100° C. to dissolve. With the temperature kept at 100° C., the flask, under stirring, is depressurized over 1 hr to a pressure of 20 mm Hg. A reaction is continued for 7 hrs as it is. The melting point thereof is 66° C.

Recovery of Catalyst and Polyester Resin

According to a method similar to Example 2-1, the catalyst and the polyester resin are recovered.

Manufacture of Electrophotographic Toner 2-(2)

Electrophotographic toner 2-(2) is prepared in a similar manner as in the "manufacture of electrophotographic toner 2-1)" in Example 2-1, except that the crystalline polyester resin (1) is changed to the crystalline polyester resin 2-(2). An average particle diameter of the obtained electrophotographic toner is measured by use of a Coulter counter (trade name: TYPE TA-II, aperture diameter: 50 μm, manufactured by Coulter Counter Co., Ltd.) and found to be 6.5 μm. When the toner is observed with an optical microscope, a spherical particle shape is confirmed.

Comparative Example 2-1

Synthesis of Comparative Crystalline Polyester Resin 2-(1)

Comparative crystalline polyester resin 2-(1) is prepared in a similar manner as in the synthesis of crystalline polyester resin 2-(1) in Example 2-1, except that 12.6 parts of non-carried scandium triflate is used as a catalyst, as raw material components. Carboxylic acid and alcohol which are similar to those in Example 1 are used. After nitrogen substitution is carried out, a temperature is elevated to 100° C. to dissolve. With the temperature kept at 100° C., the flask, under stirring, is depressurized over 1 hr to a pressure of 20 mm Hg. A reaction is continued for 7 hrs as it is, whereby a comparative polyester resin 2-(1) is obtained. The melting point thereof is 67° C.

Manufacture of Electrophotographic Toner 2-(3)

Electrophotographic toner 2-(3) is prepared in a similar manner as in the "manufacture of electrophotographic toner 2-(1)"in Example 2-1, except that a crystalline polyester resin is changed to the comparative polyester resin 2-(1). An average particle diameter of the obtained electrophotographic toner is measured by use of a Coulter counter (trade name: TYPE TA-II, aperture diameter: 50 μm, manufactured by Coulter Counter Co., Ltd.) and found to be 5.9 μm. When the toner is observed with an optical microscope, a spherical particle shape is confirmed.

Comparative Example 2-2

Synthesis of Comparative Polyester Resin 2-(2)

Comparative polyester resin 2-(2) is prepared in a similar manner as in the synthesis of crystalline polyester resin 2-(1) in Example 2-1, except in that the catalyst is changed to 10 parts of yttrium triflate, as raw material components. Carboxylic acid and alcohol which are similar to those in Example 2-1 are used. After nitrogen substitution is applied, under blending and stirring, stirring is carried out at a reaction temperature of 180° C. for 3 hrs, and under reduced pressure, a polymerization is carried out for 5 hrs. During 4 hrs after that, a temperature is finally elevated up to 220° C., finally a reaction is carried out for 12 hrs in total, whereby a comparative polyester resin 2-(2) is synthesized. The melting point thereof is 65° C.

Manufacture of Electrophotographic Toner 2-(4)

Electrophotographic toner 2-(4) is prepared in a similar manner as in the "manufacture of electrophotographic toner 2-(1)" in Example 2-1, except that the crystalline polyester resin 2-(1) is changed to the comparative polyester resin 2-(2). An average particle diameter of the obtained electrophotographic toner is measured by use of a Coulter counter (trade name: TYPE TA-II, aperture diameter: 50 μm, manufactured by Coulter Counter Co., Ltd.) and found to be 6.9 μm. When the toner is observed with an optical microscope, a spherical particle shape is confirmed.

The thus obtained electrophotographic toners 2-(1) through 2-(4) are evaluated for fixing strength, developing agent property and image storability. Evaluations of fixing strength, developing agent property image storability are carried out as follows.

Evaluation of Crease Fixing Strength

By use of a modified digital color copy machine (trade name: DOCU CENTRE COLOR 500CP, manufactured by Fuji Xerox Co., Ltd.), unfixed solid samples are prepared. A mass per unit area of the toner in each of the solid samples is controlled so as to be in a range of about 0.7 to 0.8 $mg/cm^2$.

Paper used is E COLOR 081A4PAPER (trade name, manufactured by Fuji Xerox Office Supply Co., Ltd.).

A fixing method is as follows. That is, a fixing part is taken off the modified machine, and a temperature-controllable fixing bench is separately experimentally manufactured and used. The fixing conditions are controlled so that image gloss (glossiness) becomes (75-75 degree measurement by the apparatus having the trade name: 3GM-260TYPE, manufactured by MURAKAMI Color Research Laboratory) after fixation, whereby a fixed image is obtained.

The obtained fixed sample is folded in two, followed by rolling a roll (having an external diameter of 600 mm and made of brass) having a weight of about 500 g over a folded portion at a constant speed, further followed by lightly scraping along a crease with a waste, and a state of lack of the image is observed.

The evaluation is carried out by means of sensory evaluation based on the following criteria.

Evaluation Criteria

A: A crease is generated, but there is no lack of the image or a small lack of the image.

B: A slight white crease is observed and lack of the image is partially caused.

C: A white band-like crease is apparent and lack of the image is observed in an area equal to or greater than half of the image.

Evaluation of Electrostaic Charge Image Developer

Furthermore, as to the evaluation of an electrostatic charge image developer, image formation is carried out by use of a modified digital color copy machine (trade name: DOCU CENTRE COLOR 500CP, manufactured by Fuji Xerox Co., Ltd.) and the respective images of an initial image ($10^{th}$ image) and $50000^{th}$ image are visually observed for image quality (fusion irregularity) and contamination of the background.

The image quality and background contamination are evaluated according to evaluation criteria below.

A: There is no problem with respect to the image.

B: Although a little contamination is observed, there is no practical problem.

C: Since significant contamination is observed, the image cannot be practically used.

Evaluation of Image Storability

The image storability is evaluated as follows. Two sheets of recording paper on which a fixed image is formed at a minimum fixing temperature (MFT(° C.)) are superposed with image surfaces thereof facing to each other and are left for 7 days under an environment of a temperature of 60° C. and humidity of 85% with a weight of 100 g/cm$^2$ applied thereon. The superposed images are peeled apart, and whether or not there is fusion of images between recording the papers and whether or not there is transfer in a non-image portion are visually observed, followed by evaluation according to the evaluation criteria below.

A: There is no problem with regard to image storability.

B: Although a little change is observed, there is no practical problem.

C: Since a large change is observed, the image is practically impossible to use.

These results are summarized in Table 2.

TABLE 2

| | Evaluation of image quality | | Contamination of background | | | |
|---|---|---|---|---|---|---|
| | Initial ($10^{th}$) | $50000^{th}$ | Initial ($10^{th}$) | $50000^{th}$ | Image storabilty | Fixing strength |
| Example 1-1 | A | A | A | A | A | A |
| Example 1-2 | A | A | A | A | A | A |
| Comparative example 1-1 | A | A | A | A | C | C |
| Comparative example 1-2 | A | A | C | A | C | C |

From the results shown in Table 2, the following becomes clear. That is, the electrostatic charge image developers (Examples 2-1 and 2-2) that use the electrophotographic toners containing the polyester resins synthesized by use of particular non-homogeneous catalysts, in comparison with the electrostatic charge image developers according to Comparative examples 2-1 and 2-2, exhibit less fusion irregularity of solids, are excellent in homogeneity, and exhibit less background contamination in terms of image quality, and furthermore are also excellent in image storability and the fixing strength.

Example 2-3

Except in that the non-homogeneous catalyst that is used in Example 2-1 is changed to scandium triflylimide, a polyester resin for use in an electrophotographic toner is synthesized in a similar manner as in Example 2-1. The melting point thereof is 66° C. Using the polyester resin, similarly as in Example 2-2, an electrophotographic toner and an electrostatic charge image developer are prepared and evaluated similarly as in Example 2-1. Results similar to those of Example 2-1 are obtained.

What is claimed is:

1. An electrophotographic toner comprising a binder resin and a coloring agent, wherein the binder resin is a polyester resin comprising a rare earth element in a range of about 1 to 10000 ppm.

2. The electrophotographic toner of claim 1, wherein the rare earth element is selected from the group consisting of Sc, Y, Yb and Sm.

3. The electrophotographic toner of claim 1, wherein the binder resin is synthesized with a non-homogeneous catalyst in which a rare earth metal triflate or a rare earth metal triflylimide is carried on a carrier.

4. The electrophotographic toner of claim 3, wherein the rare earth element is selected from the group consisting of Sc, Y, Yb and Sm.

5. The electrophotographic toner of claim 3, wherein the binder resin is synthesized from an acid unit having a dicarboxylic acid group and an alcohol unit having a diol group.

6. The electrophotographic toner of claim 5, wherein the rare earth element is selected from the group consisting of Sc, Y, Yb and Sm.

7. The electrophotographic toner of claim 5, wherein the polyester resin is crystalline.

8. The electrophotographic toner of claim 7, wherein the rare earth element is selected from the group consisting of Sc, Y, Yb and Sm.

9. The electrophotographic toner of claim 1, wherein the polyester resin is synthesized by use of a catalyst represented by the following Formula (1) or (2):

$$X(OSO_2CF_3)_3 \quad \text{Formula (1)}$$

$$X(N(SO_2CF_3)_2)_3 \quad \text{Formula (2)}$$

wherein X represents Sc, Y, Yb or Sm.

10. The electrophotographic toner of claim 9, wherein the polyester resin is synthesized from acid units having dicarboxylic acid groups and alcohol units having diol groups.

11. The electrophotographic toner of claim 9, wherein the polyester resin is crystalline.

12. A method for manufacturing an electrophotographic toner comprising:

blending a particle dispersion solution of a binder resin and a particle dispersion solution of a coloring agent to aggregate particles of the binder resin and particles of the coloring agent; and heating the aggregated particles to a temperature equal to or greater than a glass transition temperature or a melting point of the binder resin to fuse aggregated particles, wherein the binder resin is a polyester resin for use in an electrophotographic toner, the binder resin comprising a rare earth element in a range of about 1 to 10000 ppm, wherein the polyester resin is synthesized with a non-homogeneous catalyst in which a rare earth metal triflate or a rare earth metal triflylimide is carried on a carrier.

13. The method for manufacturing an electrophotographic toner of claim 12, wherein the rare earth element is selected from the group consisting of Sc, Y, Yb and Sm.

14. The method for manufacturing an electrophotographic toner of claim 12, wherein the polyester resin is synthesized from acid units having dicarboxylic acid groups and alcohol units having diol groups.

15. An image forming method comprising:

forming an electrostatic latent image on a surface of a latent image holder;

developing, by use of a developer carried on a developer carrier, the electrostatic latent image formed on the surface of a latent image holder to form a toner image;

transferring the toner image formed on the surface of the latent image holder onto a surface of a transfer receiving material; and thermally fixing the transferred toner image on the surface of the material, wherein the developer comprises a carrier and an electrophotographic toner;

the electrophotographic toner comprises a binder resin and a coloring agent; and the binder resin is a polyester resin for use in an electrophotographic toner, the binder resin comprising a rare earth element in a range of about 1 to 10000 ppm, wherein the polyester resin is synthesized with a non-homogeneous catalyst in which a rare earth metal triflate or a rare earth metal triflylimide is carried on a carrier.

16. The image forming method of claim 15, wherein the rare earth element is selected from the group consisting of Sc, Y, Yb and Sm.

17. The image forming method of claim 15, wherein the polyester resin is synthesized from an acid unit having a dicarboxylic acid group and an alcohol unit having a diol group.

* * * * *